US005697725A

United States Patent [19]

Ballash et al.

[11] Patent Number: 5,697,725

[45] Date of Patent: Dec. 16, 1997

[54] STUD TO PLATE TIE

[75] Inventors: Evon M. C. Ballash, Palo Alto, Calif.; Michael Wagner, Mesa, Ariz.

[73] Assignee: Simpson Strong-Tie Company, Inc., Pleasanton, Calif.

[21] Appl. No.: 814,092

[22] Filed: Mar. 10, 1997

Related U.S. Application Data

[63] Continuation of Ser. No. 665,744, Jun. 18, 1996, abandoned.

[51] Int. Cl.[6] ..... E04B 1/38; F16B 7/00

[52] U.S. Cl. ..... 403/231; 403/4; 52/712; 52/696

[58] Field of Search ..... 403/232.1, 231, 403/233, 234, 4; 52/702, 712, 715, 696

[56] References Cited

U.S. PATENT DOCUMENTS

| | | | |
|---|---|---|---|
| 2,666,238 | 1/1954 | Hagedorn . | |
| 2,704,868 | 3/1955 | Danielson | 52/715 X |
| 4,570,407 | 2/1986 | Palacio et al. | 52/712 X |
| 4,730,971 | 3/1988 | Lin et al. | 411/463 |
| 5,150,982 | 9/1992 | Gilb | 403/232.1 |
| 5,403,110 | 4/1995 | Sammann | 403/234 |
| 5,410,854 | 5/1995 | Kimmell et al. | 52/712 |
| 5,488,810 | 2/1996 | Horton | 52/715 |

FOREIGN PATENT DOCUMENTS

| | | | |
|---|---|---|---|
| 2026124 | 1/1980 | United Kingdom | 52/712 |

OTHER PUBLICATIONS

Simpson Strong-Tie Co., Inc. Catalog C-96, copyright 1995 p. 29.

Simpson Strong-Tie Co., Inc. Catalog, copyright 1994 p. 55.

*Primary Examiner*—Anthony Knight

*Attorney, Agent, or Firm*—James R. Cypher

[57] ABSTRACT

A connection in wood frame construction such as in frame walls of homes, wood framed apartment buildings and light wood framed commercial buildings. Specifically, the disclosure describes a pair of connectors for joining wood studs to a wood single base plate and to a wood double top plate for framing a wall. The two connectors used in the connection are identical and include a stud member for connection to the edge face of the stud, a plate member for connection to the edge face of the respective plates and a transition member connected at one end to the stud member and the other end is connected to the plate member. A pair of tabs connected to opposite side edges of the transition member engage the sides of the stud and a pair of prong locators serve the dual purpose of locating the connector at the lower end of the stud in relation to the base plate and for temporary and permanent attachment of the connector attached to the upper end of the stud to the top plate.

5 Claims, 3 Drawing Sheets

STUD TO PLATE TIE

BACKGROUND OF THE INVENTION

This application is a continuation of application Ser. No. 08/665,744, filed Jun. 18, 1996 now abandoned.

The most common connection in the construction of a residential or light frame commercial building is the connection of the vertical wall framing studs to the bottom and top horizontal wood plates. This connection is most commonly made by toe nailing at an angle through an end of the stud into the respective top or bottom wood plate.

The problem with the toe nail stud to plate connection is the fact that end splitting of the stud is common; particularly if installation is effected by an unskilled workman but the main problem is that toe nailing creates inadequate resistance to uplift where the structure is subject to earthquake or high wind forces.

Some commercially available metal connectors have been placed on the market, which decrease wood splitting and improve uplift resistance, but these metal connectors, if designed for double base plates, cannot be used for attaching the bottom of the stud to a single wood base plate. Moreover, such stud to plate metal connectors fail to provide holding as well as placement devices to speed the construction of the building frame wall.

The gist of the present invention is to provide a sheet metal connector for connecting vertical studs to horizontal wood plates which is easier to use and to install than presently known connectors.

Another purpose of the present connector is to provide holding prongs which temporarily hold the connector to the plate while the permanent fasteners are installed.

Still another purpose of the present connector is to provide tabs to assist the installer in correctly attaching the vertical studs to the horizontal plates.

A still further purpose of the present connector is to provide a single connector which can be interchangeably used to connect the stud to either a top double wood plate or a bottom single wood plate.

Another purpose of the present connector is to provide easy installation by allowing for full hammer strokes and quick installation with the best line of sight installation by providing that all nails are installed on the outside surface of the stud and plates.

A further objective is to provide a connector in which all fasteners are in shear resistance rather than "pull-out" resistance.

DESCRIPTION OF THE INVENTION

Figure 1:
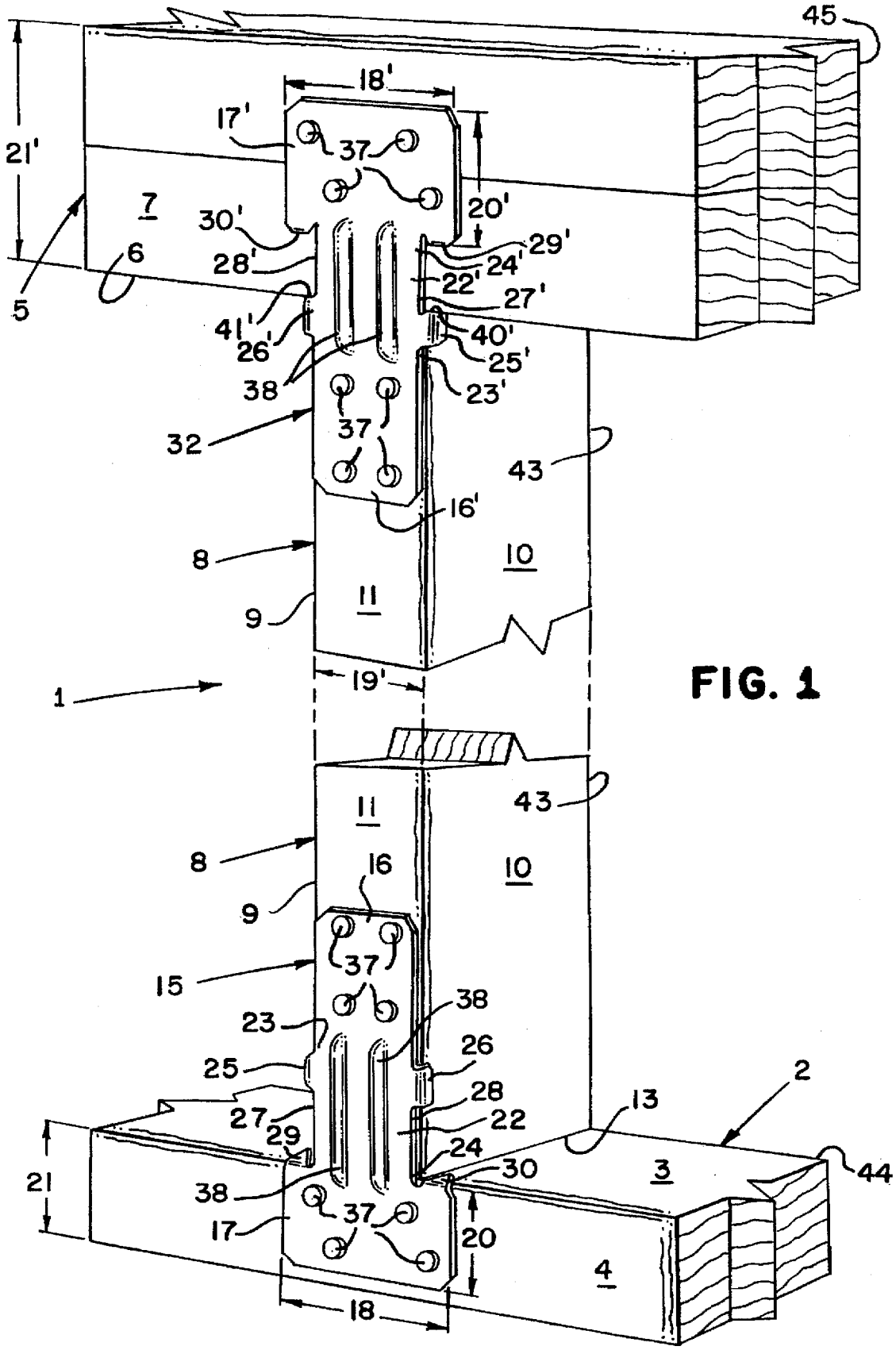
FIG. 1 is a perspective view of the connection illustrating the connector of the present invention installed on the bottom end of a stud and connected to a wood single bottom plate and an identical connector installed on the upper end of the stud and connected to a double wood top plate.
Figure 2:
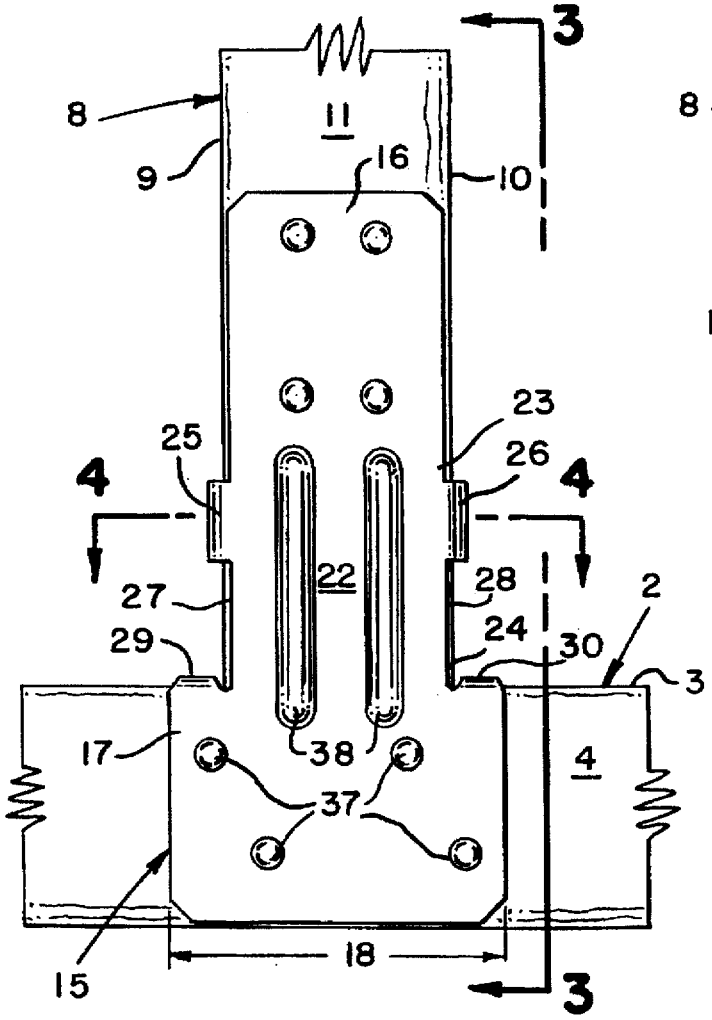
FIG. 2 is an elevation view of the connector illustrated in FIG. 1.
Figure 3:
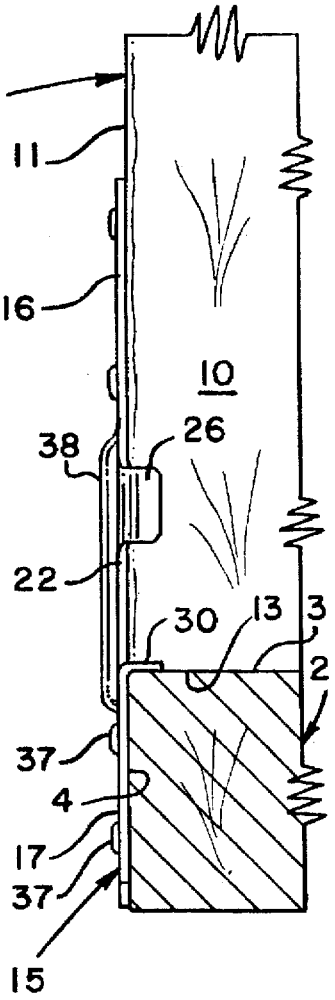
FIG. 3 is a partial cross sectional view taken along line 3—3 in FIG. 2
Figure 4:
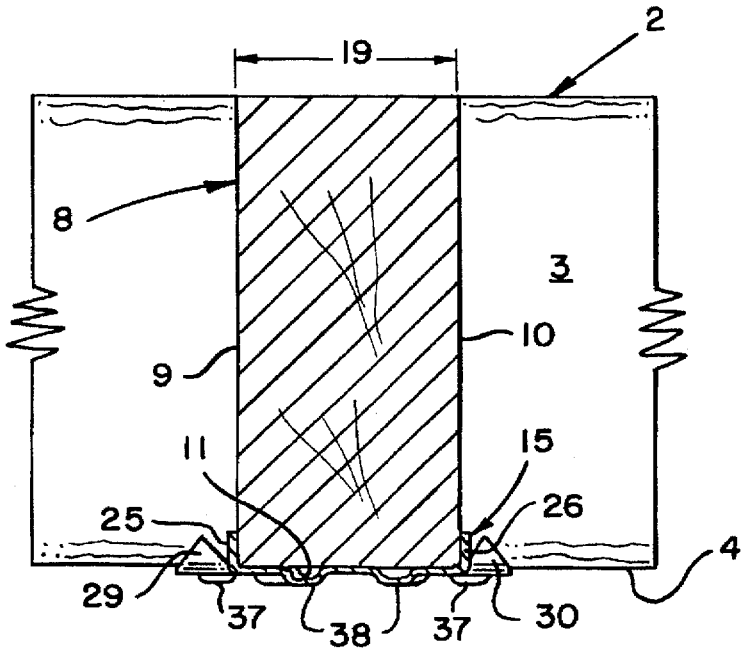
FIG. 4 is a cross sectional view taken along line 4—4 in FIG. 2.
Figure 5:
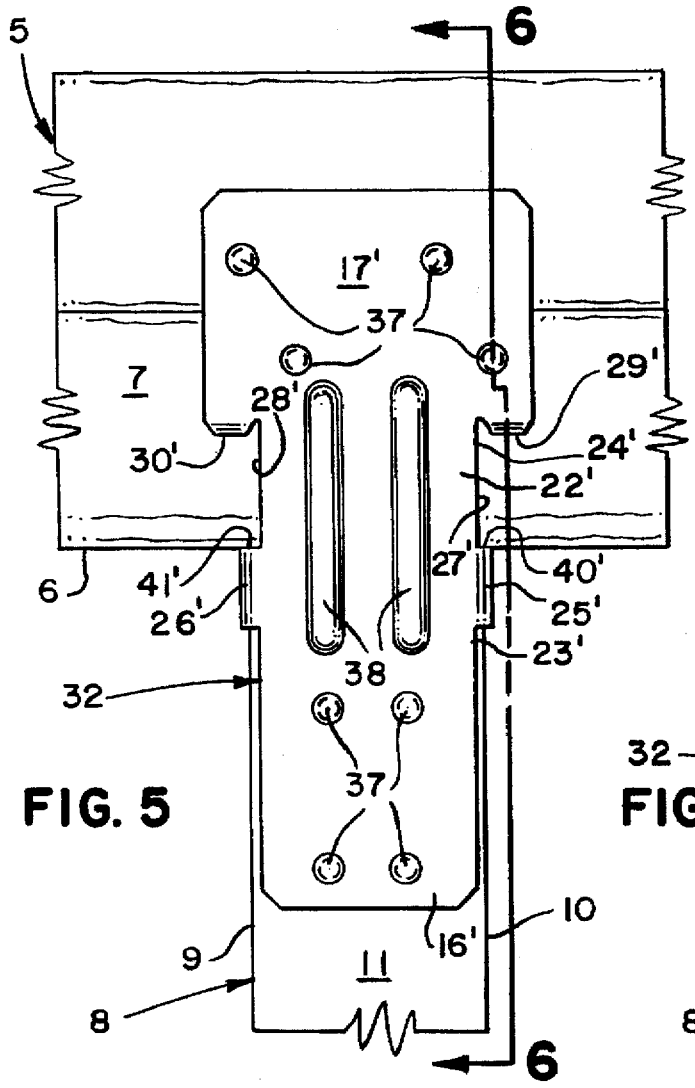
FIG. 5 is an elevation view of the stud to plate connector of the present invention attached to the double wood top plate illustrated in FIG. 1.
Figure 6:
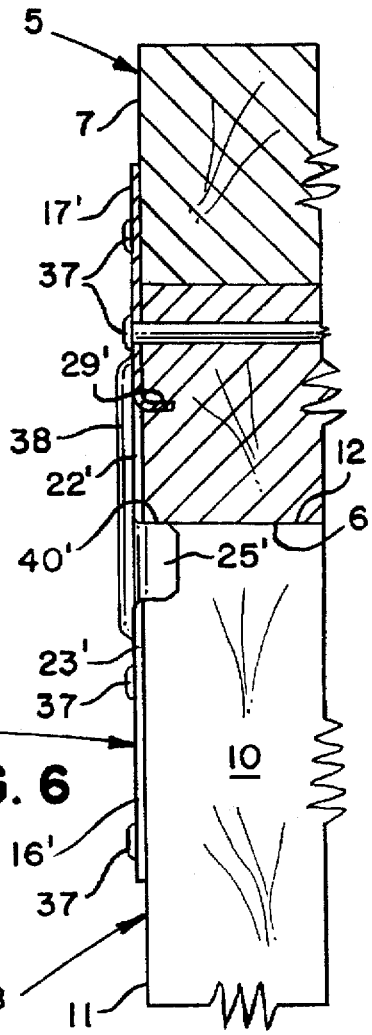
FIG. 6 is a cross sectional view of the connector illustrated in FIG. 5 taken along line 6—6.

The stud to plate tie connection 1 of the present invention is most commonly found in a wood frame structure such as a house or wood framed apartment building or a wood frame light commercial building and includes: a single base plate 2 having an upper face 3 and an edge face 4; a double top plate 5 having a lower face 6 and an edge face 7; an elongated stud 8 having generally planar and parallel sides 9 and 10 and an edge face 11 therebetween and having an upper end 12 in butting registration with the lower face 6 of the double top plate 5 and a lower end 13 in butting registration with the upper face 3 of the single base plate 2; a first stud to plate tie connector 15 having a stud member 16 for connection to the edge face 11 of the elongated stud 8, a plate member 17 for connection to the edge face 4 of the single base plate 2 and having a width 18 greater than the edge width 19 of the elongated stud 8 and a length 20 less than the edge width 21 of the single base plate 2, a transition member 22 connected at one end 23 to the stud member 16 and connected to the plate member 17 at its other end 24, a pair of tabs 25 and 26 connected to opposite side edges 27 and 28 of the transition member 22 for respectively engaging the sides 9 and 10 of the elongated stud 8, and a pair of spaced prong locators 29 and 30 connected to the plate member 17 and projecting at a right angle thereto for engaging the upper face 3 of the single base plate 2; and a second stud to plate tie connector 32 identical to the first stud to plate tie connector 15 having: a stud member 16' for connection to the edge face 11 of the elongated stud 8, a plate member 17' for connection to the edge face 7 of the double top plate 5 and having a width 18' greater than the edge width 19' of the elongated stud 8 and a length 20' less than the edge width 21' of the double top plate 5, a transition member 22' connected at one end 23' to the stud member 16' and connected to the plate member 17' at its other end 24', a pair of tabs 25' and 26' connected to opposite side edges 27' and 28' of the transition member 22' for respectively engaging the sides 9 and 10 of the elongated stud 8, and a pair of spaced prong locators 29' and 30' connected to the plate member 17' and projecting at a right angle thereto for engaging the edge face 7 of the double top plate 5.

Preferably the stud members 16 and 16' and the plate members 17 and 17' in the first and second stud to plate tie connectors 15 and 32 are formed with indicia means 35 and 36 for indicating the location of fasteners in the stud to plate tie connection 1 as described above.

In the stud to plate tie connection 1 as described above in most instances the indicia means 35 and 36 are openings for the receipt of fasteners 37.

In another form of the invention the stud to plate tie connection as described above is formed so that the transition members 22 of both of the stud to plate tie connectors 15 and 32 are formed with axially aligned embossments 38.

As an example, the stud to plate tie connector may have an overall dimension of 4½" with a stud member 16 width of 1⅜" and a plate member 17 width 18 of 2⅛". Four 8 d×1½ nails may be used for attaching stud member 16 to elongated stud 8 and four 8 d×1½ nails to attach plate member 17 to single base plate 2 as well as double top plate 5.

The average ultimate load of the stud to plate tie connector 15 and 32 is 1,032 pounds with a code allowable uplift load of 315 pounds.

Installation of the stud to plate tie connection is as follows. Referring to the lower portion of FIG. 1, elongated stud 8 is first located at a selected position on single base plate 2 in the normal manner. First stud to plate tie connector 15 is then placed against edge face 11 of elongated stud 8 so that tabs 25 and 26 engage generally planar and parallel sides 9 and 10 of stud 8. First stud to plate tie connector 15 is then slid down edge face 11 of stud 8 until prong locators 29 and 30 register with upper face 3 of single base plate 2. Fasteners 37 are then driven into edge face 4 of single base plate 2 until the plate member 17 is secure. Next fasteners 37 are driven through indicia means 36 such as the indicia means set forth in U.S. Pat. No. 4,841,690 with a power nailer or the indicia means may simply be openings through which nails may be driven with a hammer or screws may be inserted with a screw driver or power screw driver.

Finally, nails or screws may be inserted through the stud member 16 at indicia means locations 35 which may also be openings punched in the metal.

Next second stud to plate tie connector 32 as shown in the upper portion of FIG. 1 which is identical to first stud to plate tie connector 15 is selected and placed against stud 8 so that tabs 25' and 26' engage planar and parallel sides 9 and 10 of stud 8. The first stud to plate tie connector 15 is moved upwardly until the edges 40' and 41' of tabs 25' and 26' engage lower face 6 of double top plate 5. Next, prong locators 29' and 30' on plate member 17' are inserted into edge face 7 of double top plate 5 by a hammer blow to plate member 17'. Fasteners 37 are then inserted through plate member 17' at indicia points such as openings 36.

No toe nailing of stud 8 to either the single base plate 2 or the double top plate 5 is required. Unlike toe nailing, the use of the stud to plate tie connection 1 as just described, provides considerable resistance to uplift forces which during wind or seismic activity attempt to lift the stud 8 from single base plate 2 or attempt to lift the double top plate 5 off stud 8. Since all of the fasteners 37 are in shear and none of the fasteners are in "pull out", the maximum allowable uplift value is permitted under the I building codes.

As previously discussed, the ability to use a single identical connector 15 and 32 for connection of the stud 8 to both the single base plate 2 and the double top plate 5 permits easier material ordering for the job and the installers need only carry one set of connectors in framing the walls of a building.

The drawings only show installation of first stud to plate tie connector 15 and second stud to plate tie connector 32 on one edge face of stud 8 and one edge face 4 of single base plate 2 and one edge face 7 of double top plate 5. To achieve even greater resistance to up lift forces, a second set of first and second stud top plate tie connectors 15 and 32 could be attached to back edge 43 of stud 8 and back edge face 44 of single base plate 2 and back edge face of double top plate 5.

By attaching first and second stud to plate tie connectors 15 and 32 to both sides of the stud 8, single base plate 2 and double top plate 5, a much greater resistance to uplift may be achieved to resist wind and seismic forces than could possibly be achieved by conventional toe nailing of the studs to the base and top plates.

In addition, attaching first and second stud to plate tie connectors 15 and 32 to both sides of the stud 8, single base plate 2 and double top plate 5 provides resistance to skewing of the studs with relation to the single base plate 2 and double top plates 5, provides resistance to movement of the elongated stud 8 axially of the single base plate 2 and double top plate 5 and at right angles to the axis of the single base plate 2 and the double top plate 5.

Figure 7:
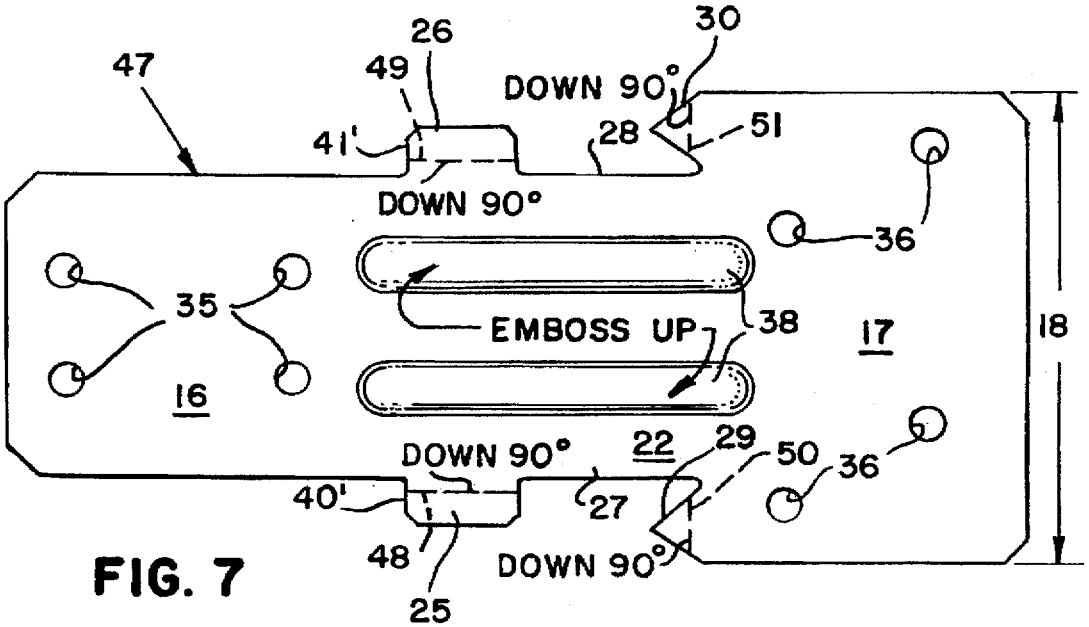
FIG. 7 is a drawing of the blank of the stud to plate connector of the present invention prior to bending.

The first and second stud to plate tie connectors 15 and 16 which are identical, are easily made from 20 gauge galvanized steel by standard stamping and folding means. As shown in FIG. 7, a blank 47 of sheet metal, after cutting, but before bending is shown. Tabs 25 and 26 are formed by bending them down at 90° along bend lines 48 and 49. Prong locators 29 and 30 are formed by bending them down at 90° along bend lines 50 and 51 as illustrated in "FIG. 7.

We claim:

1. A stud to plate tie connection in a wood frame structure comprising:

a. a single base plate having an upper face and an edge face;

b. a double top plate having a lower face and an edge face;

c. an elongated stud having generally planar and parallel sides and an edge face therebetween and having an upper end in butting registration with said lower face of said double top plate and a lower end in butting registration with said upper face of said single base plate;

d. a first stud to plate tie connector having (1) a stud member for connection to said edge face of said elongated stud, (2) a plate member for connection to said edge face of said single base plate and having a width greater than the edge width of said elongated stud and a length less than the edge width of said single base plate, (3) a transition member connected at one end to said stud member and connected to said plate member at its other end, (4) a pair of tabs connected to opposite side edges of said transition member for respectively engaging said sides of said elongated stud, and (5) a pair of spaced prong locators connected to said plate member and projecting at a right angle thereto for engaging said upper face of said single base plate; and e. a second stud to plate tie connector identical to said first stud to plate tie connector having:

(1) a stud member for connection to said edge face of said elongated stud, (2) a plate member for connection to said edge face of said double top plate and having a width greater than the edge width of said elongated stud and a length less than the edge width of said double top plate, (3) a transition member connected at one end to said stud member and connected to said plate member at its other end, (4) a pair of tabs connected to opposite side edges of said transition member for respectively engaging said sides of said elongated stud, and (5) a pair of spaced prong locators connected to said plate member and projecting at a right angle thereto for engaging said edge face of said double top plate.

2. A stud to plate tie connection as described in claim 1 wherein:

a. said stud members and said plate members in said first and second stud to plate tie connectors are formed with indicia means for indicating the location of fasteners.

3. A stud to plate tie connection as described in claim 2 wherein said indicia means are openings for the receipt of fasteners.

4. A stud to plate tie connection as described in claim 1 comprising:

a. said transition members of both of said stud to plate tie connectors are formed with axially aligned embossments.

5. A stud to plate tie connection in a wood frame structure comprising:

a. a single base plate having an upper face and an edge face;

b. a double top plate having a lower face and an edge face;

c. an elongated stud having generally planar and parallel sides and an edge face therebetween and having an upper end in butting registration with said lower face of said double top plate and a lower end in butting registration with said upper face of said single base plate;

d. a first stud to plate tie connector having
   (1) a stud member for connection to said edge face of said elongated stud,
   (2) a plate member for connection to said edge face of said single base plate,
   (3) a transition member connected at one end to said stud member and connected to said plate member at its other end; and
   (4) a pair of tabs connected to opposite side edges of said transition member for respectively engaging said sides of said elongated stud; and e. a second stud to plate tie connector identical to said first stud to plate tie connector having:
   (1) a stud member for connection to said edge face of said elongated stud,
   (2) a plate member for connection to said edge face of said double top plate and having a length equal to or less than the edge width of said double top plate,
   (3) a transition member connected at one end to said stud member and connected to said plate member at its other end; and
   (4) a pair of tabs connected to opposite side edges of said transition member for respectively engaging said sides of said elongated stud, and having end edges located to engage said lower face of said double top plate.

* * * * *